US010812916B2

(12) United States Patent
Pedersen

(10) Patent No.: US 10,812,916 B2
(45) Date of Patent: Oct. 20, 2020

(54) HEARING INSTRUMENT WITH A SEPARATE LINK

(71) Applicant: GN HEARING A/S, Ballerup (DK)

(72) Inventor: Brian Dam Pedersen, Ringsted (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 14/251,088

(22) Filed: Apr. 11, 2014

(65) Prior Publication Data

US 2015/0289066 A1 Oct. 8, 2015

(30) Foreign Application Priority Data

Apr. 4, 2014 (DK) ..... 2014 70177
Apr. 4, 2014 (EP) ..... 14163562

(51) Int. Cl.
*H04R 25/00* (2006.01)
*H04R 27/02* (2006.01)
*H04R 1/10* (2006.01)

(52) U.S. Cl.
CPC ..... *H04R 25/554* (2013.01); *H04R 27/02* (2013.01); *H04R 1/10* (2013.01)

(58) Field of Classification Search
CPC .. H04R 25/558; H04R 25/554; H04R 25/505; H04R 25/552; H04R 25/70
USPC ..... 381/315; 340/14.69, 4.61; 235/451
See application file for complete search history.

(56) References Cited

U.S. PATENT DOCUMENTS

2002/0069067 A1 6/2002 Klinefelter et al.
2005/0122932 A1 6/2005 Walter
2005/0134436 A1* 6/2005 Brookner ..... G06K 7/0008 340/14.69
2006/0273920 A1 12/2006 Doan et al.
2007/0262157 A1* 11/2007 Cargonja ..... G06K 7/0008 235/492
2007/0265964 A1* 11/2007 Berardi ..... G06Q 20/00 705/44
2008/0270305 A1 10/2008 Andreasson et al.
2011/0194713 A1 8/2011 Apfel et al.
2014/0064528 A1 3/2014 Flood et al.

FOREIGN PATENT DOCUMENTS

EP 2 337 377 A1 6/2011
EP 2 866 470 A1 4/2015

OTHER PUBLICATIONS

Extended European Search Report dated Sep. 18, 2014 for related EP Patent Application No. 14163562.3, 7 pages.
Richard V. Cox et al., "Speech and Language Processing for Next-Millennium Communications Services" Proceedings of the IEEE, IEEE. New York, US, vol. 88, No. 8, Aug. 1, 2000, 24 pages.

(Continued)

*Primary Examiner* — Phylesha Dabney
(74) *Attorney, Agent, or Firm* — Vista IP Law Group, LLP

(57) ABSTRACT

A hearing instrument includes: a wireless receiver configured for reception of a message relating to a ticket issued for a user of the hearing instrument by a ticket management system; a processing unit configured for processing the message according to a hearing loss of the user; and a speaker configured to convert the processed message into an acoustic signal for transmission towards an eardrum of the user.

25 Claims, 4 Drawing Sheets

(56) References Cited

OTHER PUBLICATIONS

Second Technical Examination dated Mar. 11, 2015 for corresponding Danish Patent Application No. PA 2014 70177, 3 pages.
Communication pursuant to Article 94(3) EPC dated May 6, 2015, for corresponding European Patent Application No. 14163562.3, 4 pages.
Third Technical Examination—Intention to Grant dated Apr. 24, 2015, for corresponding Danish Patent Application No. PA 2014 70177, 2 pages.
Examination and Search Report dated Jul. 3, 2014 in Application No. PA 2014 70177 (5 pages).

* cited by examiner

301

| 305 Associated device | 302 Identifier | 303 Measured signal strength received by 21 | 304 Supports audio streaming |
|---|---|---|---|
| device 4 | device 3 | 4 | 1 |
| | device 5 | 3 | 1 |
| device 3 | device 4 | 2 | 1 |
| | device 6 | 1 | 0 |
| | | | |

Fig. 4

HEARING INSTRUMENT WITH A SEPARATE LINK

RELATED APPLICATION DATA

This application claims priority to and the benefit of European Patent Application No. 14163562.3, filed on Apr. 4, 2014, pending, and Danish Patent Application No. PA 2014 70177, filed on Apr. 4, 2014, pending. The entire disclosures of both of the above applications are expressly incorporated by reference herein.

FIELD OF TECHNOLOGY

A new hearing instrument is provided comprising a wireless receiver configured for reception of a message relating to a ticket issued by a ticket management system and acquired by a user of the hearing instrument, wherein the ticket management system has associated the ticket with the hearing instrument, and wherein the hearing instrument is further configured for converting the message into an acoustic signal for transmission towards an eardrum of the user.

BACKGROUND

Recently hearing aids have emerged that are capable of presenting sound received from various sources to a user of the hearing aid. Examples of sources include mobile phones, radios, media players, companion microphones, broadcasting systems, e.g. used in public places, e.g. in churches, auditoriums, theatres, cinemas, etc., public address systems, e.g. used in railway stations, airports, shopping malls, etc., etc.

For example, it is well known to use a telecoil to magnetically pick up audio signals generated, e.g., by telephones, FM systems (with neck loops), and induction loop systems (also called "hearing loops"), whereby sound may be transmitted to hearing aids with a high signal to noise ratio. More recently, hearing aids have been equipped with radio circuits for reception of radio signals, e.g. replacing or supplementing telecoils, for reception of streamed audio in general, such as streamed music and speech from media players, such as MP3-players, TV-sets, etc.

Hearing aids have also emerged that connect with various sources of audio signals through a short-range network, e.g. including Bluetooth technology, e.g. to interconnect the hearing aid with cellular phones, audio headsets, computer laptops, personal digital assistants, digital cameras, etc., or other networks, such as HomeRF, DECT, PHS, Wireless LAN (WLAN), etc., or other proprietary networks.

SUMMARY

In some situations, for example in a public place, it is desirable for a user wearing a hearing instrument to be able to listen to, possibly broadcasted, messages associated with and sent to the new hearing instrument.

For example, in banks, post offices, some retail stores, doctors' offices, hospitals, town halls, social security offices, etc., tickets with numbers are taken from a machine to form a virtual queue. A display may then show the number that was last called for service and/or a new or next number called for service may be publically announced, e.g. through loudspeakers at the queueing area.

When a user wearing the new hearing instrument takes a number, the number is associated with the new hearing instrument. Subsequently, when the number of the user is called for service, the user is alerted by a call for service message being transmitted to and received by the hearing instrument of the user. Another call for service relating to another number is not received by the hearing instrument.

Likewise, another type of public announcement, e.g. relating to a train, ship or flight departure or delay, relating to a ticket bought by the user, and wherein the ticket has been associated with the hearing instrument when the user bought the ticket to the respective means of transportation, may be transmitted to and received by the hearing instrument of the user. For example, when certain rows including the seat of the user of the hearing instrument, are called for boarding at an airport gate, the user is alerted by the boarding message, namely the call for boarding of certain rows that include the seat acquired by the user, being transmitted to and received by the hearing instrument of the user. Another boarding call that does not include the seat of the user of the hearing instrument is not received by the hearing instrument of the user.

The ticket may be acquired by the user in a large variety of ways. One way requires the physical presence of the user wearing the hearing instrument at a specific location where the ticket is acquired and the hearing instrument is identified and associated with the ticket so that a message relating to the ticket acquired by the user of the hearing instrument can be transmitted to and received by the hearing instrument.

Other ways of acquiring a ticket do not require the physical presence of the user. Tickets may be acquired through the Internet and the user may submit identification information of the hearing instrument when acquiring a ticket so that a message, e.g. a paging message, relating to the acquired ticket, can be transmitted to and received by the hearing instrument, e.g., when the service relating to the ticket is available to the user of the hearing instrument.

Various apps for smartphones are available for acquiring tickets to a large variety of events and other services. These apps may be modified and configured to also accept hearing instrument identification information entered by the user or, preferably, automatically transmitted to the smartphone by the hearing instrument, for association with the acquired ticket so that a message, e.g. a paging message, relating to the acquired ticket can be transmitted to and received by the hearing instrument, possibly via the smartphone, e.g. when the service relating to the ticket is available to the user of the hearing instrument.

Accordingly, a new hearing instrument is provided comprising a wireless receiver configured for reception of a message relating to a ticket issued by a ticket management system and acquired by a user of the hearing instrument, wherein the ticket management system has associated the ticket with the hearing instrument, and wherein the hearing instrument is further configured for converting the message into an acoustic signal for transmission towards an eardrum of the user.

The wireless receiver may be configured for communication with a wireless network.

The wireless receiver may form part of a wireless transceiver.

The wireless transceiver may be configured for communication with a wireless network.

The hearing instrument may comprise an input transducer, e.g. a microphone, a telecoil, etc., configured to output an audio signal based on a signal applied to the input transducer, optionally a signal processor configured for processing the audio signal.

The hearing instrument may comprise an output transducer, e.g. one or two loudspeakers (usually termed receivers in hearing instrument applications), etc., configured to output an acoustic sound signal for emission towards an eardrum of the user based on the, optionally processed, audio signal.

The processor may be configured to compensate a hearing loss of the user of the hearing instrument and output a hearing loss compensated audio signal, e.g., the hearing instrument may aim to restore loudness, such that loudness of the applied signal, as it would have been perceived by a normal listener, substantially matches the loudness of the hearing loss compensated signal as perceived by the user.

The hearing instrument may further be configured for muting at least one other signal, e.g. an audio signal from an input transducer of the hearing instrument, and/or one or more signals from other signal sources received by the wireless receiver, received by the hearing instrument during the transmission towards an eardrum of the user. In this way, the user is allowed to concentrate on the message while possible distractions are reduced.

The hearing instrument may further be configured for mixing the message with at least one other signal, e.g. an audio signal from an input transducer of the hearing instrument, and/or one or more signals from other signal sources received by the wireless receiver, received by the hearing instrument, and for converting the mixed output into the acoustic signal for transmission towards the eardrum of the user of the hearing instrument.

The hearing instrument may further comprise an authenticator configured for authentication of the ticket management system, and the hearing instrument may further be configured for converting the message into an acoustic signal for transmission towards the eardrum of the user of the hearing instrument upon successful authentication of the ticket management system.

The hearing instrument may be used together with a hand-held device, such as a tablet computer, a smart phone, e.g. an IPhone, an Android phone, a Windows phone, etc., etc.

The hearing instrument may comprise a data interface for transmission of data, such as data identifying the hearing instrument, to the hand-held device and/or the ticket management system.

The data interface may be a wired interface, e.g. a USB interface, or a wireless interface, such as a Bluetooth interface, e.g. a Bluetooth Low Energy interface.

The hearing instrument may comprise an audio interface for reception of an audio signal from a hand-held device.

The audio interface may be a wired interface or a wireless interface.

The data interface and the audio interface may be combined into a single interface, e.g. a USB interface, a Bluetooth interface, a Bluetooth Low Energy interface, etc.

A ticket management system is also provided, comprising
a transceiver,
a user interface, and
a processor,
wherein the processor is configured for
issuing a ticket to a user of a hearing instrument, upon reception of a corresponding user request entered by the user using the user interface, and
associating the ticket with the hearing instrument so that the transceiver can transmit a message relating to the ticket to the hearing instrument and the hearing instrument can receive the message.

The ticket management system may also be configured to display the message, or a corresponding message, on a display.

The ticket management system may also be configured to publically announce the message, or a corresponding message, e.g. through loudspeakers at the queueing area.

The ticket management system may further comprise an encoder configured for encoding a signature identifying the ticket management system for transmission together with the message.

The ticket management system, e.g. the transceiver, may comprise an interface to the Internet so that the message can be transmitted to and received by the hearing instrument through the Internet.

The associating may comprise establishing an ad hoc network between the ticket management system and the hearing instrument; and measuring a transmission property of the hearing instrument in said ad hoc network.

The ad hoc network may be a Bluetooth Low Energy network.

The transmission property of the hearing instrument may be a RSSI value of at least one data package received by the ticket management system from the hearing instrument via said ad hoc network in a time period comprising the user request.

The time period may be a millisecond.

Each of the transceivers of the hearing instrument and the ticket management system may be a device or a circuit comprising both a wireless transmitter and a wireless receiver. The transmitter and receiver may share common circuitry and/or a single housing. Alternatively, the transmitter and receiver may share no circuitry, and the transceiver may comprise separate devices with the transmitter and the receiver, respectively.

Every hearing instrument stores its own data identifying the hearing instrument, e.g. an identification number, e.g. a 32-bit number. Globally unique identities are not required since the probability of two users having hearing instruments with identical identification data is negligible.

Further, a method is provided for transmitting a message from a ticket management system to a hearing instrument, wherein the ticket management system comprises a transceiver and a user interface, the method comprising
receiving a user request for a ticket from a user of the hearing instrument,
issuing a ticket to the user,
associating the ticket to the hearing instrument of the user, and
receiving with the hearing instrument a message relating to the ticket.

The method may further comprise
generating a signature identifying the ticket management system,
transmitting the signature together with the message,
authenticating the ticket management system in the hearing instrument based on the transmitted signature, and
converting the message in the hearing instrument into an acoustic signal for transmission towards the eardrum of the user of the hearing instrument upon successful authentication of the ticket management system.

In the method, the step of generating may include encrypting the signature.

In the method, the step of authenticating may include decrypting the encrypted signature included in the message for authentication of the ticket management system.

The hearing instrument may be a hearing aid, such as a BTE, RIE, ITE, ITC, CIC, etc., a binaural hearing aid, an Ear-Hook, In-Ear, On-Ear, Over-the-Ear, Behind-the-Neck, Helmet, Headguard, etc., headset, headphone, earphone, ear defender, earmuff, etc.

The message may be a text message that is converted into speech in the hearing instrument, or in a hand-held device communicating with the hearing instrument. Preferably, the message is a spoken message.

Throughout the present disclosure a message relating to the ticket, is a message that can be received by the hearing instrument in any form it may take from generation of the message, e.g. the acoustic output from a human speaker, e.g. making an announcement, to transmission towards the eardrum of the user of the hearing instrument, including the digitized message in a form suitable for wireless transmission and in a form suitable for signal processing in the hearing instrument.

The hearing instrument may be configured for ignoring the message upon failed authentication of the ticket management system, so that the hearing instrument user will not be bothered with messages from unauthorized sources.

The hearing instrument may have a mixer with an input connected to an output of the receiver receiving the message and other inputs connected to other transmitters of audio signals, such as input transducer(s) of the hearing instrument, and an output providing an audio signal that is a weighted combination of the audio signals input to the mixer.

In the mixer, muting may be performed by setting the weights of other signals than the message to zero.

In the mixer, ignoring messages from unauthorized sources may be performed by setting the weight of the message to zero.

In the event that the authenticator does successfully authenticate the ticket management system, the hearing instrument may be configured to adjust the weights of the mixer so that other signals currently transmitted to the user are attenuated during transmission of the message to the user so that the message can be clearly heard by the user without the user simultaneously loosing connection with other signals received by the hearing instrument. For example, attenuation of acoustic signals from the surroundings of the user received by a microphone of the hearing instrument during transmission of the message, allows the user to stay connected with the surroundings while simultaneously listening to the message.

The hearing instrument may be configured to always mute one or more other signals received by the hearing instrument during transmission of the message towards the eardrum of the user of the hearing instrument.

The hearing instrument may have a user interface, e.g. a push button, a remote control, etc. so that the user can switch muting of other signals on and off as desired in order to be able to or not be able to, respectively, continue to listen to other sound signals while receiving the message, as desired.

The user interface may further include means for user adjustment of the weights of the combination of the input audio signals, such as a dial, or a push button for incremental adjustment.

In order for the hearing instrument to be able to authenticate the ticket management system, an electronic signature uniquely identifying the ticket management system may be included in the message.

Preferably, the electronic signature is encrypted for secure authentication of the ticket management system.

The electronic signature may include a digital certificate issued by a certificate authority.

The electronic signature may include a hash code, such as a message authentication code, in order for the hearing instrument to be able to authenticate the ticket management system in a cryptographically simple way.

Signal processing in the new hearing instrument may be performed by dedicated hardware or may be performed in one or more signal processors, or performed in a combination of dedicated hardware and one or more signal processors.

A hearing instrument includes: a wireless receiver configured for reception of a message relating to a ticket issued for a user of the hearing instrument by a ticket management system; a processing unit configured for processing the message according to a hearing loss of the user; and a speaker configured to convert the processed message into an acoustic signal for transmission towards an eardrum of the user.

Optionally, the hearing instrument further includes a wireless transmitter configured for transmission of a signal to the ticket management system with data identifying the hearing instrument.

Optionally, the processing unit is further configured for mixing the message with at least one other signal received by the hearing instrument to obtain a mixed output, and for processing the mixed output according to the hearing loss of the user.

A ticket management system includes: a transceiver; a user interface; and a processing unit configured for: issuing a ticket to a user of a hearing instrument, upon reception of a corresponding user request entered by the user using the user interface, associating the ticket with the hearing instrument, and control the transceiver to transmit a message relating to the ticket to the hearing instrument based at least in part on the association of the ticket with the hearing instrument.

Optionally, the ticket management system further includes an encoder configured for encoding a signature identifying the ticket management system for transmission together with the message.

Optionally, the transceiver comprises an interface to the Internet, and wherein the transceiver is configured to transmit the message to the hearing instrument through the Internet.

Optionally, the processing unit is configured to perform the act of associating by: establishing an ad hoc network between the ticket management system and the hearing instrument; and measuring a transmission property of the hearing instrument in the ad hoc network.

Optionally, the ad hoc network is a Bluetooth Low Energy network.

A method of communication between a ticket management system and a hearing instrument, wherein the ticket management system comprises a transceiver and a user interface, the method includes: receiving, at the ticket management system, a user request for a ticket from a user of the hearing instrument; issuing a ticket by the ticket management system to the user; associating the ticket with the hearing instrument of the user; and transmitting a message relating to the ticket from the ticket management system to the hearing instrument.

Optionally, the method further includes generating a signature identifying the ticket management system, wherein the signature is transmitted together with the message to the hearing instrument.

Optionally, the method further includes: authenticating the ticket management system in the hearing instrument based on the transmitted signature; and converting the message in the hearing instrument into an acoustic signal for transmission towards an eardrum of the user upon successful authentication of the ticket management system.

As used in this disclosure, the term "processing unit" may refer to any item that is capable of performing signal processing. For example, the term "processing unit" may refer to one or more processor(s), such as one or more signal processor(s), or any integrated circuit. The term "processing unit" may include software or a combination of hardware and software. Also, as used herein, the terms "processor", "signal processor", etc., are intended to refer to CPU-related entities, either hardware, a combination of hardware and software, software, or software in execution.

For example, a "processor", "signal processor", etc., may be, but is not limited to being, a process running on a processor, a processor, an object, an executable file, a thread of execution, and/or a program.

By way of illustration, the terms "processor", "signal processor", etc., designate both an application running on a processor and a hardware processor. One or more "processors", "signal processors", and the like, or any combination hereof, may reside within a process and/or thread of execution, and one or more "processors", "signal processors", etc., or any combination hereof, may be localized on one hardware processor, possibly in combination with other hardware circuitry, and/or distributed between two or more hardware processors, possibly in combination with other hardware circuitry.

Also, a processor (or similar terms) may be any component or any combination of components that is capable of performing signal processing. For examples, the signal processor may be an ASIC processor, a FPGA processor, a general purpose processor, a microprocessor, a circuit component, or an integrated circuit.

Other aspects and features will be evident from reading the following detailed description.

BRIEF DESCRIPTION OF THE DRAWINGS

In the following, preferred embodiments of the new hearing instrument are explained in more detail with reference to the drawing, wherein:

FIG. 4 is a list which may be stored in a memory of the point of sale.

DETAILED DESCRIPTION

Figure 1:
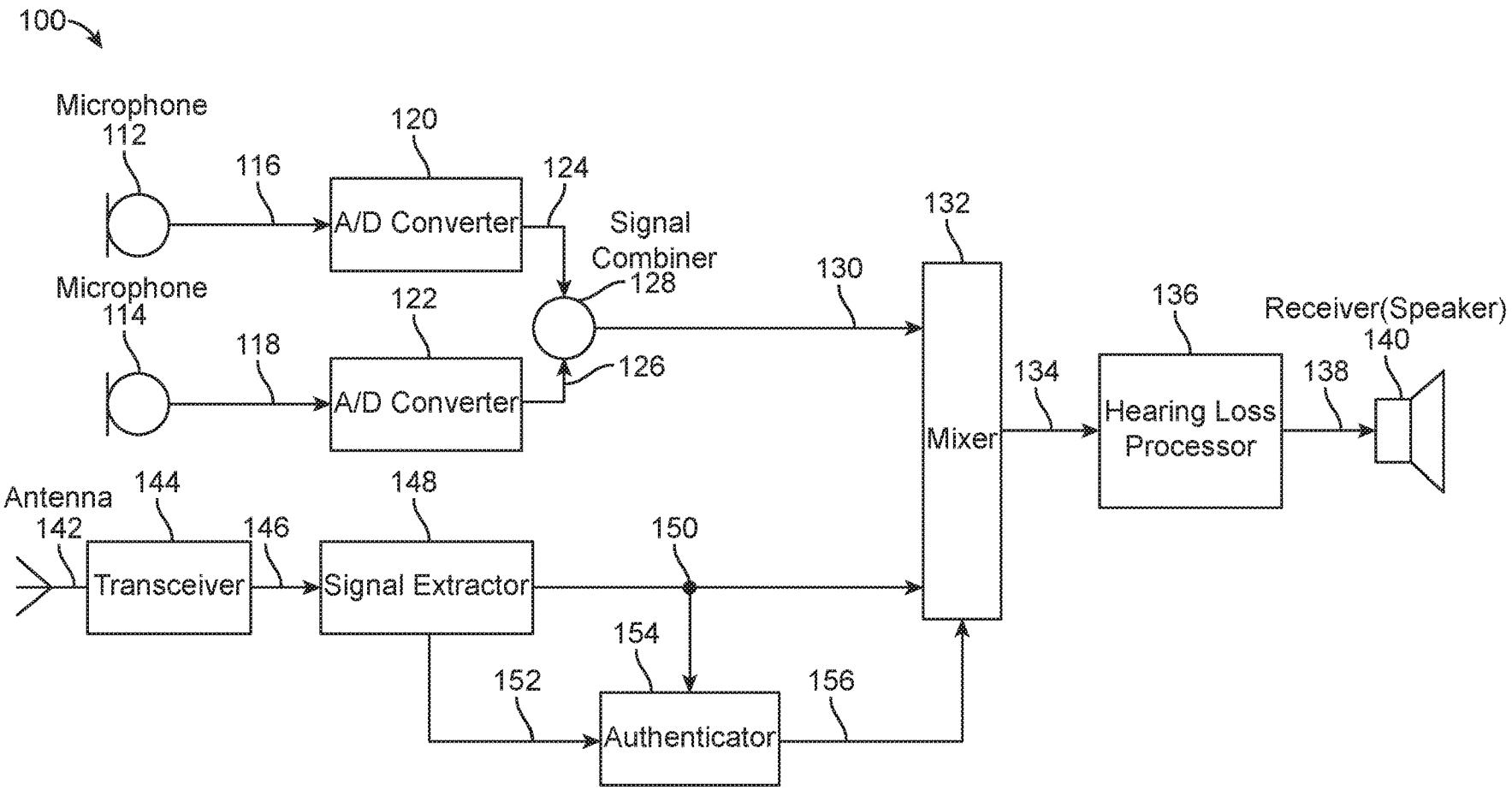
FIG. 1 schematically illustrates electronic circuitry of the new hearing instrument.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The new method and hearing instrument will now be described more fully hereinafter with reference to the accompanying drawings, in which various examples of the new method and hearing instrument are illustrated. The new method and hearing instrument according to the appended claims may, however, be embodied in different forms and should not be construed as limited to the examples set forth herein.

FIG. 1 schematically illustrates exemplary hearing instrument circuitry 100 of the new hearing instrument. The illustrated new hearing instrument is a hearing aid that may be of any suitable mechanical design, e.g. to be worn in the ear canal, or partly in the ear canal, behind the ear or in the concha, such as the well-known types: BTE, RIE, ITE, ITC, CIC, etc.

The illustrated hearing instrument circuitry 100 comprises a front microphone 112 and a rear microphone 114 for conversion of an acoustic sound signal from the surroundings into corresponding microphone audio signals 116, 118 output by the microphones 112, 114. The microphone audio signals 116, 118 are digitized in respective A/D converters 120, 122 for conversion of the respective microphone audio signals 116, 118 into respective digital microphone audio signals 124, 126 that are optionally pre-filtered (pre-filters not shown) and combined in signal combiner 128, for example for formation of a digital microphone audio signal 130 with directionality as is well-known in the art of hearing aids. The digital microphone audio signal 130 is input to the mixer 132 configured to output a weighted sum 134 of signals input to the mixer 132. The mixer output 134 is input to a hearing loss processor 136 configured to generate a hearing loss compensated output signal 138 based on the mixer output 134. The hearing loss compensated output signal 138 is input to a receiver (speaker) 140 for conversion into acoustic sound for transmission towards an eardrum (not shown) of a user of the hearing instrument.

The illustrated hearing instrument circuitry 100 is further configured to receive digital audio from various transmitters, such as mobile phones, radios, media players, companion microphones, broadcasting systems, such as in a public place, e.g. in a church, an auditorium, a theatre, a cinema, a bank, a post office, a retail store, a doctor's office, a hospital, a town hall, a social security office, etc., public address systems, such as in a railway station, an airport, a shopping mall, etc., etc.

In the illustrated example, digital audio, including spoken messages, is transmitted wirelessly to the hearing instrument and received by the hearing instrument antenna 142 connected to a radio transceiver 144. The radio transceiver retrieves the digital data 146 from the received radio signal, including a device address identifying the device for which the digital audio is intended, the digital audio, possible transmitter identifiers, possible network control signals, etc. Provided that the received address matches the address of the hearing instrument, signal extractor 148 extracts the digital audio 150 from the received digital data 146 and forwards the digital audio 150 to the mixer 132. The digital audio 150 may include audio from a plurality of sources and thus, the digital audio 150 may form a plurality of input signals for the mixer 132, one input signal for each source of audio. The other signals may be attenuated during transmission of the message towards the eardrum of the user of the hearing instrument. The other signals may also be muted. The user may enter a command through a user interface of the hearing instrument of a type well-known in the art, controlling whether the other signals are muted or attenuated.

As further explained below, digital data of the message optionally also contains data 152 relating to the identity of the ticket management system. With such data, the signal extractor 148 extracts these data 152 from the digital data and forwards them to optional authenticator 154 that is configured to authenticate the ticket management system. Optional output authentication signal 156 forms a control input to the mixer 132 for control of the weights of the sum of mixer input signals.

In the event that the ticket management system cannot be authenticated, the corresponding weight of the ticket management system part of the message is set to zero in the mixer 132 so that the message is not transmitted to the user; rather the message is ignored.

In the event that the ticket management system is authenticated, the message is transmitted to the user while the other signals are attenuated during transmission of the message.

The mixer 132 may have memories for storage of information received during ongoing transmission of the message towards the eardrum of the user of the hearing instrument. Stored information may then be input to the mixer subsequent to finalized transmission of the message towards the eardrum of the user of the hearing instrument in the same order in which they have been received by the hearing instrument, or, in order of priority, for inclusion in the output of the mixer 132.

The hearing instrument may be configured to always mute one or more other signals received by the hearing instrument during transmission of a message from the ticket management system towards the eardrum of the user of the hearing instrument.

In some embodiments, item 120, 122, 128, 132, 136, 148, 154, or any combination of the foregoing (e.g., items 120, 122, 128, and 132, or items 132 and 148, or items 132 and 154, etc.) may be considered to be an example of a processing unit.

Figure 2:
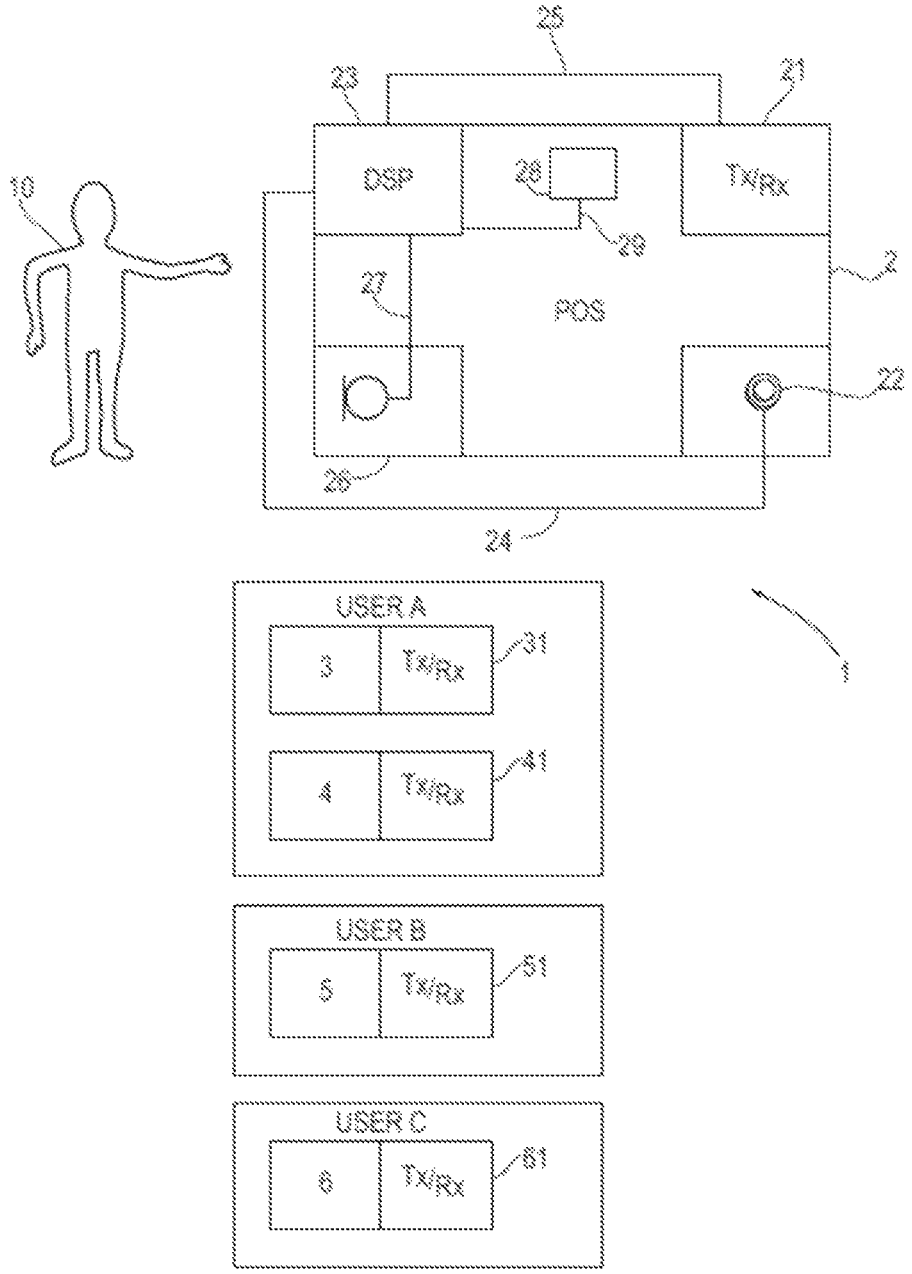
FIG. 2 shows a point of sale system.

FIG. 2 shows a point of sale 1 with a ticket management system 2 and a number of devices 3, 4, 5, and 6 worn by users.

The illustrated ticket management system 2 comprises a processor 23, a transceiver (TX/RX) 21, such as a RF transceiver, an input transducer 26, such as a microphone, and an activator 22, such as a push button, or the like. The ticket management system 2 may be situated in a ticket office, a bank counter, a post office, a retail store, or the like.

The activator 22 is communicatively coupled to the processor 23 wirelessly, e.g. via Bluetooth or the like, or wired, e.g. via a cable or the like, via link 24. The transceiver 21 may be embodied as a transmitter and a receiver configured for transmitting and/or receiving wireless data from at least one of the number of devices 3, 4, 5, and 6. The transceiver 21 is communicatively coupled to the processor 23 wirelessly, e.g. via Bluetooth or the like, or wired, e.g. via a cable or the like, via link 25. In the illustrated ticket management system 2, the transceiver 21 is configured for transmitting and/or receiving wireless data from a plurality of devices 3, 4, 5, and 6.

The transceiver 21 communicates with the at least one of the devices 3, 4, 5, and 6 via a wireless communication interface in an industrial, scientific and medical (ISM) band, e.g. in accordance with a Bluetooth, or a Bluetooth-like, communication protocol, e.g. in a 2.4-2.5 GHz band.

In the illustrated ticket management system 2, the input transducer 26 is a microphone directed towards a person 10, such as a clerk or the like, operating the ticket management system 2.

The processor 23, which may be an example of a processing unit, may be a central processing unit (CPU), a digital signal processor (DSP) or the like. In the illustrated ticket management system 2, the processor 23 is configured for processing data to and/or from the activator 22.

In the illustrated ticket management system 2, the processor 23 is configured for transmitting and/or receiving data via the transceiver 21.

In the illustrated ticket management system 2, the processor is configured for receiving data from the activator 22.

In the illustrated ticket management system 2, the processor 23 is adapted to control one or more features of activator 22 such as e.g. tactile resistance, tactility, color, or the like.

Each of the devices 3, 4, 5, and 6 comprises a transceiver 31, 41, 51, 61, such as a wireless transceiver.

In the illustrated ticket management system 2, the device 3 is a first hearing aid, the device 4 is a second hearing aid, the device 5 is a mobile telephone, and the device 6 is a tablet personal computer, each of which contains a respective transceiver 31, 41, 51, 61 configured for wireless transmission and reception of data.

Each of the transceivers 31, 41, 51, 61 is configured for wireless communicative coupling to the ticket management system 2 for transmission and reception of wireless data to and from the ticket management system 2. In the illustrated ticket management system 2, the transceivers 31, 41, 51, 61 communicates wirelessly with the ticket management system 2 via a wireless communication interface in an industrial, scientific and medical (ISM) band in accordance with Bluetooth, or a Bluetooth-like communication protocol, e.g. in a 2.4-2.5 GHz band.

In FIG. 2, first user A carries a hearing instrument, namely a binaural hearing aid comprising the first hearing aid 3 and the second hearing aid 4, second user B carries mobile telephone 5, and third user C carries tablet personal computer 6.

The users A, B, and C are waiting to be served at the point of sale 1. For example, user A is the next to be served, user B is behind user A i.e. waiting to be served after user A, and user C is behind user B, i.e. waiting to be served after user B.

When a hearing instrument carrying person, such as user A, arrives at the point of sale 1 to be served, the person activates activator 22, e.g. by pushing a push-button, in order to receive his or her number in the virtual queue at the point of sale 1. In response to the activation of activator 22, the ticket management system 2 issues the next available number to user A and associates the issued number to the hearing instrument worn by user A. When user A is called for service, the ticket management system 2 transmits a corresponding message, e.g. an audio signal containing a message with information that the issued number can be served, to the hearing instrument 3, 4 worn by user A. In other words, this message was associated with the hearing instrument worn by user A, when the issued number was associated with the hearing instrument worn by user A.

Once activated, an active-signal is transmitted from the activator 22 to the processor 23 indicating an activation of the activator 22. The active-signal activates a routine or algorithm in processor 23 which turns on a receiver-part of the transceiver 21.

The receiver-part of the transceiver 21 detects radio frequency signals transmitted from one or more of the devices 3, 4, 5 and 6. In the illustrated ticket management system 2, the receiver-part of the transceiver 21 detects a first radio frequency signal transmitted from device 3, a second radio frequency signal transmitted from device 4, a third radio frequency signal transmitted from device 5, and a fourth radio frequency signal transmitted from device 6. In the illustrated ticket management system 2, the receiver-part of the transceiver 21 detects a radio frequency signal transmitted from a proper subset of the devices 3, 4, 5, and 6, e.g. from the subset comprising devices 3, 4, 6.

In the illustrated ticket management system 2, the radio frequency detection is performed in a period of time such as two seconds or the like from the activation of the activator 22. In the illustrated ticket management system 2, the ticket management system 2 is configured to perform the radio frequency detection continuously prior to, during and after the activation of the activator 22.

In the illustrated ticket management system 2, the radio frequency signals transmitted by the first and/or second hearing aid are radio beacons transmitted at a regular period such as once every second or the like. In a further embodiment, one or both of devices 5 and 6 may also be configured for transmitting similar radio beacons at a regular period.

The radio frequency signals detected by the receiver-part of the transceiver 21 are transmitted from the transceiver 21 to the processor 23 via link 25. In the illustrated ticket management system 2, the detected radio frequency signals are transmitted from the transceiver 21 to the processor 23 after the expiry of the detection period e.g. two seconds.

In the illustrated ticket management system 2, the processor 23 calculates and/or measures and/or determines a quality value for each of the devices 3, 4, 5, and 6 based on the respective detected radio frequency signals received from the transceiver 21. The processor 23 further associates the respective quality value to each of the devices 3, 4, 5, and 6. In the illustrated ticket management system 2, the quality value is a received signal strength indicator RSSI. In another ticket management system 2, the quality value is received channel power indicator RCPE. In yet another ticket management system 2, the quality value is signal to noise ratio SNR.

Based on the quality values, the processor 23 selects the device with the largest/highest quality value for reception of a message, since the largest/highest quality value of the selected device is relied on as an indication that a user carrying the selected device is closest to the activator 22 at the time of activation of the activator 22.

In the illustrated ticket management system 2, the quality value is RSSI and the transceiver 21 may have detected a high amplitude radio frequency signal from device 3, the transceiver 21 may have detected a medium-low amplitude radio frequency signal from device 4, the transceiver 21 may have detected a medium-high amplitude radio frequency signal from device 5, and the transceiver 21 may have detected a low amplitude radio frequency signal from device 6, at or near the time of activation of the activator 22.

Based on the detected radio frequency signal from device 3, the processor 23 calculates and/or measures and/or determines a quality value associated with device 3. The processor 23 may for example associate a RSSI value of 4 (large/high value) with device 3. Based on the detected radio frequency signal from device 4, the processor 23 calculates and/or measures and/or determines a quality value associated with device 4. The processor 23 may for example associate a RSSI value of 2 (medium-low value) with device 4. Based on the detected radio frequency signal from device 5, the processor 23 calculates and/or measures and/or determines a quality value associated with device 5. The processor 23 may for example associate a RSSI value of 3 (medium high value) with device 5. Based on the detected radio frequency signal from device 6, the processor 23 calculates and/or measures and/or determines a quality value associated with device 6. The processor 23 may for example associate a RSSI value of 1 (low value) with device 6.

In the illustrated ticket management system 2, the calculated and/or measured and/or determined quality values is stored in a list in a memory 28, such as a RAM, communicatively coupled to the processor 23 via communication link 29, or included in the processor 23. The stored quality values are associated with an identifier representing the respective device such that an entry in the list in the memory 28 contains an identifier associated with device 3 and the quality value calculated and/or measured and/or determined for device 3. The list contains similarly entries for the other devices as shown in FIG. 4.

In the illustrated ticket management system 2, the processor 23 is further configured for setting a flag for each entry in the list indicating whether the device identified by said entry supports audio streaming. The detected devices 3, 4, 5, and 6 may in the illustrated ticket management system 2 transmit information regarding streaming capabilities to the transceiver 21 which the processor 23 may utilize to set the flag.

Based on the associated quality values, the processor 23 determines that device 3 is closest to the ticket management system 2 at activation of the activator 22 due to the highest/largest quality value, and therefore associates the number in the virtual queue issued in response to the activation, with hearing aid 3, and thus, the processor 23 associates a corresponding message with hearing aid 3 in that the processor 23 selects hearing aid 3 as the receiver of a message with the information that user A is called for service that the transceiver 21 transmits when the number associated with hearing aid 3 is called for service.

The processor 23 generates the message by activation of the microphone 26 so that the person 10 operating the ticket management system 2 can call the next in line for service, in this case user A, whereby an analog voice signal of the person 10 is converted into an analogue voice signal subsequently converted into a digital voice signal in an analogue-to-digital converter (not shown) and transmitted to processor 23 via link 27 and from processor 23 to transceiver 21 via link 25.

Further, the processor 23 controls the transceiver 21 to transmit a digital audio stream representing the digital voice signal to the selected device, namely hearing aid 3. In this way, the processor 23 controls the transceiver 21 to stream the voice signal from the person 10 to the user A carrying device 3 thereby ensuring a private secure transmission of audio data from the ticket management system 2 to the selected hearing aid 3.

In the illustrated ticket management system 2, the microphone 26 is continuously active i.e. before, during and after the activation of activator 22, and the processor processes the audio signal from the microphone 26 continuously i.e. before, during and after activation of activator 22. The processor 23 controls the transceiver 21 to send a "call for service"-message to the device associated with number in the virtual queue that is called for service. The other devices do not receive the message.

The illustrated ticket management system 2 may further be configured to broadcast specific type(s) of messages, such as emergency messages or the like, to all devices at the point of sale that have been associated with numbers in the virtual queue and/or that are located within reach of the transceiver 21.

In the illustrated ticket management system 2, the processor 23 may encrypt the digital voice signal according to an encryption algorithm such that the transceiver 21 transmits an encrypted audio stream to the device 3. In the illustrated ticket management system 2, the encryption algorithm is selected from the group consisting of private-key encryption and public-key encryption.

In the illustrated ticket management system 2, at least one of the devices 3, 4, 5, and 6 is configured for including a radio beacon in the radio frequency signals transmitted from the at least one devices 3, 4, 5, and 6 to the transceiver 21 of the ticket management system 2. In the illustrated ticket management system 2, all the devices 3, 4, 5, and 6 are configured for including a radio beacon in the radio frequency signals transmitted from the respective device 3, 4, 5, and 6 to the transceiver 21 of the ticket management system 2.

In the illustrated ticket management system 2, the selected device 3 is communicatively coupled to a contra-lateral device 4 e.g. in a binaural hearing aid system. The ticket management system 2 is configured for requesting the selected device 3 an identifier associated with the contra-lateral device 4. When the processor 23 selects the selected device 3 based on the quality value, the processor 23 may transmit a request to the selected device 3 via transceiver 21. The request may contain a request for an identifier of a contra-lateral device 4. The selected device 3 is configured for responding to the request by transmitting an identifier identifying the contra-lateral device 4 to the processor 23 via transceiver 21 if such a contra-lateral device 4 exists; otherwise the selected device 3 may respond with a predetermined code e.g. a zero or the like. The processor 23 may store the identifier of the contra-lateral device 4 in the memory 28. In the illustrated ticket management system 2, the identifier of the contra-lateral device 4 is marked as associated with the selected device 3 in the memory. Subsequently, the ticket management system 2 may stream the voice signal from the clerk 10 to the selected device 3 and the contra-lateral device 4. Thereby is ensured that the contra-lateral device 4 is uniquely identified. Due to shadow effects, the contra-lateral device 4 may provide a substantially less strong signal to the transceiver 21 of the ticket management system 2 than the selected device 3 and therefore selection of the contra-lateral device based on the list may be faulty. The method of requesting an identifier for a contra-lateral device removes this problem.

In the illustrated ticket management system 2, the ticket management system 2 may continue to stream audio data to the device 3 and possibly also device 4 if identified, until the user A activates a button on one of the devices 3 and 4, which activation enables the device 3 and/or device 4 to transmit a signal to the processor 23 via transceiver 21 indicating a stop of the stream. Subsequently after reception of the stop signal from one or both of devices 3 and 4, the ticket management system 2 stops streaming the audio stream to the devices 3 and 4.

Figure 3:
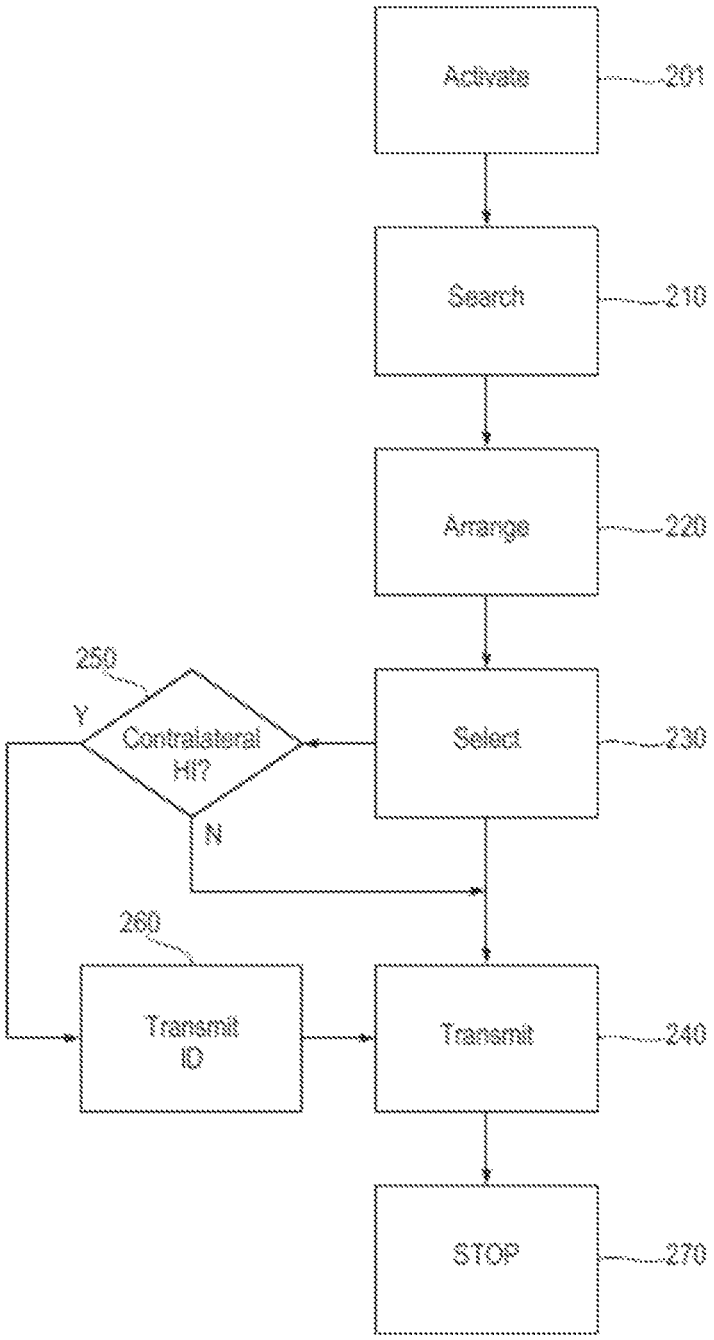
FIG. 3 is a flowchart of a method of sending a message from a ticket management system to a hearing instrument.

FIG. 3 shows an embodiment of a method of securely transmitting a message from a ticket management system 2 to a device, such as a hearing aid 3.

In a first step, step 201, a user A activates an activator 22 of the ticket management system 2.

The activation of the activator 22 starts a second step, a search step 210, wherein the ticket management system 2 searches for wireless radio frequency signals. The search is performed by the transceiver 21 controlled by the processor 23 via link 25. The wireless radio frequency signals sought after by the ticket management system 2 is emitted by the device 3 carried by user A, by device 4 also carried by user A, by device 5 carried by user B and device 6 carried by user C.

In the illustrated ticket management system 2, the search is carried out continuously by the ticket management system 2 i.e. before, during and after the activation of the activator 22. When the activator 22 is activated, the devices 3, 4, 5, and 6 detected by the transceiver 21 at the moment of activation, are stored in a list or the like in a memory 28 communicatively coupled to the processor 23 via link 29 together with identification information, such as Device ID profile DIP as known from Bluetooth, and signal strength and/or quality, such as RSSI, for each of the detected devices 3, 4, 5, and 6.

In the illustrated ticket management system 2, the search is carried out in a period of time, e.g. two seconds or the like, after the activation of the activator. When the activator 22 is activated, the devices 3, 4, 5, and 6 detected by the transceiver 21 in the two seconds, or the like, after the activation of the activator 22, are stored in a list or the like in the memory 28 communicatively coupled to the processor 23 together with identification information and signal strength and/or quality for each of the detected devices 3, 4, 5, and 6.

In the illustrated ticket management system 2, the processor 23 orders and/or arranges, in a step 220, the items in the list according to the signal strength such that the device with the highest signal strength detected by transceiver 21 at the time of activation of activator 22 is placed at the top of the list.

Based on the measured signal strength of the detected devices 3, 4, 5, and 6, the ticket management system 2 selects, in a step 230, the device with the highest signal strength at the time of activation, or shortly thereafter. Then, the ticket management system 2 illustrated in FIG. 2 issues a ticket with the next available number in the virtual queue and associates the number with the selected device and stores the associated number together with the ID of the selected device in memory 28. The ticket management system 2 also dispenses the ticket with the number printed on it with a ticket dispenser (not shown), and the user with the device takes the ticket.

In a subsequent step 240, the ticket management system 2 starts to send a message with streamed audio data from a microphone 26 recording voice data from the person 10 to a device associated with the number in the virtual queue that is called for service by the person 10. In this way, other users carrying other devices that are still in line in the virtual queue do not receive the message that the ticket management system 2 transmits to the device called for service, e.g. hearing aid 3, whereby a user of a device associated with a number in the virtual queue is relieved from receiving messages intended for other users.

In the illustrated ticket management system 2, the ticket management system 2 requests an identifier, in a step 250 following step 230, from the selected device 3 to a contra-lateral device 4 communicatively coupled to a selected device 3 e.g. via a wireless communication protocol. Due to shadow effects and the like, the contra-lateral device 4 need not be subsequent to the selected device in the list in the memory.

In a subsequent step 260, the selected device 3 transmits an identifier of the contra-lateral device 4 to the ticket management system 2.

Subsequently, the ticket management system 2 transmits the message both to the selected device 3 and the contralateral device 4 carried by user A having activated the activator 22 in step 240.

The search for wireless radio frequency signals stops in step 270 when the person 10 or another person deactivates the activator 22.

FIG. 4 shows an embodiment of a list which is stored in a memory 28 of the ticket management system 2 by the processor 23. The list 301 contains a column 302 containing identifiers for each of the devices 3, 4, 5, and 6 detected by the transceiver 21. Further, the list contains a column 303 containing a quality value for each of the detected devices 3, 4, 5, and 6 measured and/or calculated and/or determined by the processor 23 via detected signals received from transceiver 21 via link 25. Additionally, the list contains a column 304 containing a flag or a binary value for each of the detected devices 3, 4, 5, and 6 indicating whether the device supports audio streaming. In FIG. 4, a binary value of 1 indicates that audio streaming is enabled in the device and a binary value of 0 indicates that audio streaming is disabled.

Although the ticket management system 2 has been described as having a processor 23, it should be noted that the ticket management system 2 includes any processing unit configured to perform the features described herein.

In an embodiment, the activator 22 and an additional transceiver and an additional processing unit may be contained in a component physically separated from the ticket management system 2 and e.g. placed at an entrance of the ticket office, the bank, the post office, the retail store, or the like. In this embodiment, the transceiver of the activator component may perform the communication of transceiver 21 with the hearing instrument. Additionally, the transceiver of the component may transmit information receiver from the hearing instrument such as RSSI to the transceiver 21 ticket management system. The voice of the clerk may be transmitted via transceiver 21 to the component transceiver and from there to the hearing instrument. In an embodiment, the processing of DSP 23 may be performed by the additional processing unit in the component. In this embodiment, the DSP 23 may be reduced in complexity.

Thus, a hearing instrument is provided comprising a wireless receiver configured for reception of a message relating to a ticket issued by a ticket management system and acquired by a user of the hearing instrument, and wherein the hearing instrument is further configured for processing the message according to a hearing loss of the user and to convert the processed message into an acoustic signal for transmission towards an eardrum of the user, and optionally a wireless transmitter configured for transmission of a signal to the ticket management system with data identifying the hearing instrument, and optionally the hearing instrument is further configured for muting at least one other signal received by the hearing instrument during the transmission towards an eardrum of the user, and optionally the hearing instrument is further configured for mixing the message with at least one other signal received by the hearing instrument, and for processing the mixed output according to a hearing loss of the user and to convert the processed mixed output into the acoustic signal for transmission towards the eardrum of the user of the hearing instrument, and optionally the hearing instrument comprises an authenticator configured for authentication of the ticket management system, and optionally the hearing instrument is further configured for converting the message into an acoustic signal for transmission towards the eardrum of the user of the hearing instrument upon successful authentication of the ticket management system, and optionally the receiver forms part of a transceiver that is configured for communication with a wireless network and that optionally is configured for communication with a hand-held device.

A ticket management system is also provided, comprising a transceiver, a user interface, and a processor, wherein the processor is configured for issuing a ticket to a user of a hearing instrument, upon reception of a corresponding user request entered by the user using the user interface, and associating the ticket with the hearing instrument so that a message relating to the ticket can be transmitted from the transceiver to the hearing instrument, and optionally an encoder configured for encoding a signature identifying the ticket management system for transmission together with the message, and optionally the transceiver comprises an interface to the Internet so that the message can be transmitted to the hearing instrument through the Internet, and optionally the transceiver is configured for communication with a wireless network, and optionally the associating comprises a. establishing an ad hoc network between the ticket management system and the hearing instrument; and b. measuring a transmission property of the hearing instrument in said ad hoc network, and optionally the ad hoc network is a Bluetooth Low Energy network, and optionally the transmission property of the hearing instrument is a RSSI value of at least one data package received by the ticket management system from the hearing instrument via said ad hoc network in a time period comprising the user request, and optionally the time period is a millisecond.

A method of transmitting a message from a ticket management system to a hearing instrument is also provided, wherein the ticket management system comprises a transceiver and a user interface, and the method comprises receiving, at the ticket management system, a user request for a ticket from a user of the hearing instrument, issuing a ticket by the ticket management system to the user, associating the ticket to the hearing instrument of the user, and transmitting a message relating to the ticket from the ticket management system to the hearing instrument, and optionally generating a signature identifying the ticket management system, wherein the signature is transmitted together with the message, and optionally authenticating the ticket management system in the hearing instrument based on the transmitted signature, and converting the message in the hearing instrument into an acoustic signal for transmission towards an eardrum of the user upon successful authentication of the ticket management system, and optionally generating the signature includes encrypting the signature, and optionally authenticating the ticket management system includes decrypting the encrypted signature included in the message.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing instrument comprising:

a wireless receiver configured for reception of a message relating to a ticket issued for a user of the hearing instrument by a ticket management system, the ticket management system configured to associate the ticket with the hearing instrument;

a processing unit configured for processing the message according to a hearing loss of the user; and a speaker configured to convert the processed message into an acoustic signal for transmission towards an eardrum of the user;

wherein the hearing instrument is configured to receive a signature that is transmitted together with the message;

wherein the processing unit of the hearing instrument is further configured to mix the message from the ticket management system with an audio signal to obtain a mixed output.

2. The hearing instrument according to claim 1, further comprising a wireless transmitter configured for transmission of a signal to the ticket management system with data identifying the hearing instrument.

3. The hearing instrument according to claim 1, wherein the message is configured to summon the user.

4. The hearing instrument according to claim 1, wherein the ticket comprises information regarding an assigned order for the user.

5. The hearing instrument according to claim 1, wherein the processing unit is configured to perform a function to process the message that is different from a hearing loss compensating function.

6. The hearing instrument of claim 1, wherein the processor is configured to process the mixed output according to the hearing loss of the user.

7. The hearing instrument of claim 1, wherein the signature is encoded in a way that would allow the hearing instrument, not another hearing instrument, to decode the signature.

8. The hearing instrument of claim 1, wherein the message from the ticket management system comprises an audio message.

9. A ticket management system comprising:

a transceiver;

a user interface;

a processing unit configured for:

issuing a ticket to a user of a wireless device, upon reception of a corresponding user request entered by the user using the user interface, associating the ticket with the wireless device, and controlling the transceiver to transmit an audio message relating to the ticket to the wireless device based at least in part on the association of the ticket with the wireless device;

wherein the wireless device is a hearing instrument configured to compensate for hearing loss; and wherein the ticket management system is configured to transmit a signature together with the audio message to the hearing instrument, wherein the signature is configured to be processed by the wireless device.

10. The ticket management system according to claim 9, wherein the transceiver comprises an interface to the Internet, and wherein the transceiver is configured to transmit the audio message to the hearing instrument through the Internet.

11. The ticket management system according to claim 9, wherein the processor is configured to associate the ticket with the hearing instrument that is configured to compensate for the hearing loss.

12. The method according to claim 9, wherein the hearing instrument is a hearing aid.

13. The ticket management system of claim 9, wherein the ticket management system is configured to, before transmitting the signature, encode the signature in a way that would allow the hearing instrument, not another hearing instrument, to decode the signature.

14. A ticket management system comprising:

a transceiver;

a user interface; and a processing unit configured for:

issuing a ticket to a user of a wireless device, upon reception of a corresponding user request entered by the user using the user interface, associating the ticket with the wireless device, and controlling the transceiver to transmit an audio message relating to the ticket to the wireless device based at least in part on the association of the ticket with the wireless device;

wherein the wireless device is a hearing instrument configured to compensate for hearing loss; and wherein the processing unit is configured to perform the act of associating by:

establishing an ad hoc network between the ticket management system and the hearing instrument; and determining a transmission property of the hearing instrument in the ad hoc network, wherein the transmission property comprises a strength of a signal provided by the hearing instrument; and wherein the processing unit is configured to control the transceiver to transmit a signature for reception by the hearing instrument.

15. The ticket management system according to claim 14, further comprising an encoder configured for encoding the signature for transmission together with the audio message, the signature identifying the ticket management system.

16. The ticket management system according to claim 14, wherein the ad hoc network is a Bluetooth Low Energy network.

17. The ticket management system of claim 14, wherein the ticket management system is configured to, before transmitting the signature, encode the signature in a way that would allow the hearing instrument, not another hearing instrument, to decode the signature.

18. A method of communication between a ticket management system and a wireless device, wherein the ticket management system comprises a transceiver and a user interface, the method comprising:

receiving, at the ticket management system, a user request for a ticket from a user of the wireless device;

issuing a ticket by the ticket management system to the user;

associating the ticket with the wireless device of the user;

transmitting an audio message relating to the ticket from the ticket management system to the wireless device, wherein the wireless device is a hearing instrument configured to compensate for hearing loss; and generating a signature, wherein the signature is transmitted together with the audio message from the ticket management system to the hearing instrument, and wherein the signature is configured to be processed by the hearing instrument.

19. The method according to claim 18, wherein the act of associating comprises associating the ticket with the hearing instrument that is configured to compensate for the hearing loss.

20. The method according to claim 18, wherein the hearing instrument is a hearing aid.

21. The method of claim 18, further comprising encoding the signature in a way that would allow the hearing instrument, not another hearing instrument, to decode the signature.

22. A method of communication between a ticket management system and a wireless device, wherein the ticket management system comprises a transceiver and a user interface, the method comprising:

receiving, at the ticket management system, a user request for a ticket from a user of the wireless device;

issuing a ticket by the ticket management system to the user;

associating the ticket with the wireless device of the user;

transmitting an audio message relating to the ticket from the ticket management system to the wireless device, wherein the wireless device is a hearing instrument configured to compensate for hearing loss;

wherein the method further comprises:

generating a signature identifying the ticket management system, wherein the signature is transmitted together with the audio message from the ticket management system to the hearing instrument;

processing, by the hearing instrument, the transmitted signature from the ticket management system; and converting the audio message in the hearing instrument into an acoustic signal for transmission towards an eardrum of the user upon successful processing of the transmitted signature.

23. The method of claim 22, further comprising encoding the signature in a way that would allow the hearing instrument, not another hearing instrument, to decode the signature.

24. A hearing instrument comprising:

a wireless receiver configured for reception of an audio message relating to a ticket issued for a user of the hearing instrument by a ticket management system, the ticket management system configured to associate the ticket with the hearing instrument;

a processing unit configured for processing the audio message; and a speaker configured to convert the processed message into an acoustic signal for transmission towards an eardrum of the user;

wherein the hearing instrument is configured to receive a signature that is transmitted together with the audio message by the ticket management system.

25. The hearing instrument of claim 24, wherein the signature is encoded in a way that would allow the hearing instrument, not another hearing instrument, to decode the signature, and the hearing instrument is configured to decode the signature.

* * * * *